United States Patent [19]

Lenker

[11] 4,108,027

[45] Aug. 22, 1978

[54] RATCHET WRENCH WITH DOUBLE SWIVELLING DRIVE SHAFT

[75] Inventor: Paul E. Lenker, Davenport, Iowa

[73] Assignee: Davenport Tool Co., Eldridge, Iowa

[21] Appl. No.: 787,526

[22] Filed: Apr. 14, 1977

[51] Int. Cl.[2] ..... B25B 13/46

[52] U.S. Cl. ..... 81/60; 81/57.39; 81/177 UJ

[58] Field of Search ..... 81/57.39, 177 UJ, 71, 81/60–63

[56] References Cited

U.S. PATENT DOCUMENTS

| | | | |
|---|---|---|---|
| 1,392,220 | 9/1921 | Quint | 81/177 UJ |
| 1,469,662 | 10/1923 | Leopold | 81/71 |
| 3,941,017 | 3/1976 | Lenker et al. | 81/57.39 |

*Primary Examiner*—James L. Jones, Jr.

*Attorney, Agent, or Firm*—Haven E. Simmons; James C. Nemmers

[57] ABSTRACT

The socket drive shaft of a ratchet type wrench is slidable to project from either side of the wrench to receive a socket. The drive shaft itself is formed in a generally "hour-glass" shape so that the shaft can swivel relative to the wrench and simultaneously a socket can swivel relative to the shaft.

5 Claims, 4 Drawing Figures

FIG 1
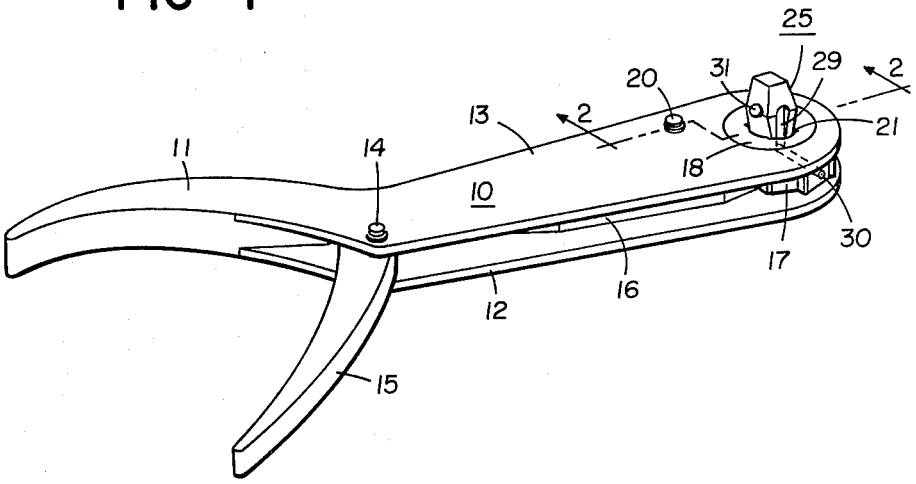
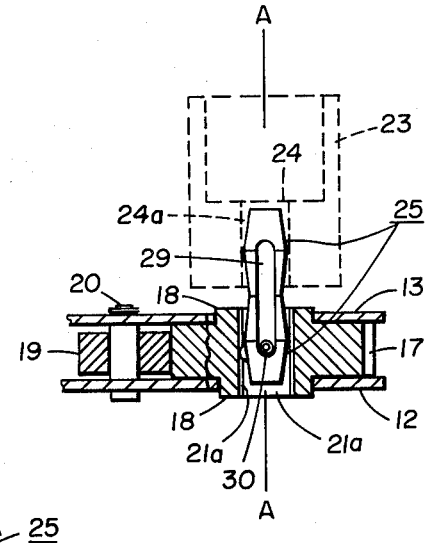
FIG 2
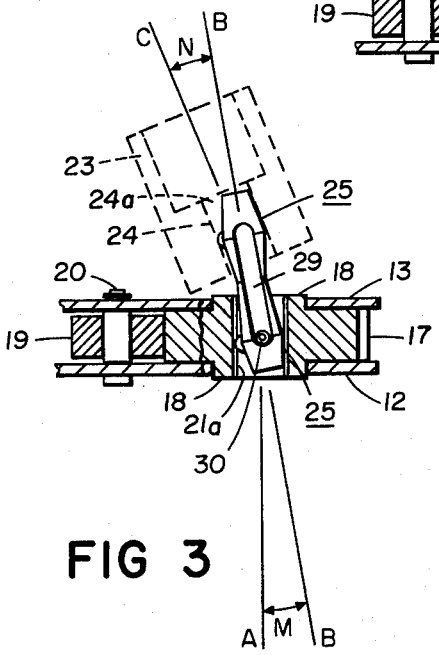
FIG 3
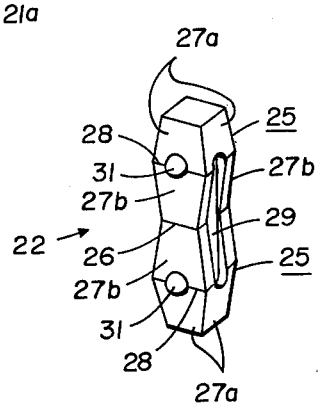
FIG 4

RATCHET WRENCH WITH DOUBLE SWIVELLING DRIVE SHAFT

BACKGROUND OF THE INVENTION

The present invention is an improvement to the "Plier Type Ratchet Wrench" shown in U.S. Pat. No. 3,941,017, though its gist is not limited just to that particular type of ratchet wrench. The basic purpose of the invention is to provide a sort of "universal joint" between the wrench and socket, which joint is an integral part of the wrench rather than a separate attachment as is typical.

It is, of course, old and well-known to provide a ratchet wrench with a drive shaft which has a limited amount of flex or "universal joint" action relative to the wrench itself. This has been achieved by, for instance, forming a sort of "ball joint" between the driven end of the drive shaft and the ratchet, rotation of the shaft relative to the ratchet being prevented by suitable means, such as splines. But so far as is known, no such wrench also provides at the same time a limited amount of "universal joint" action between the shaft and the socket.

SUMMARY OF THE INVENTION

The foregoing action is accomplished by forming the socket drive shaft of the wrench with a somewhat "hour-glass" shape. Of the two convex portions, one is located within and driven by the wrench while the other fits within the drive aperture of the socket. Accordingly, the shaft can swivel relative to the wrench while at the same time the socket can swivel relative to the shaft, all thereby providing a limited universal-like joint. Not only is a greater range of flexibility provided than if just the shaft swivels relative to the wrench, as in the prior art, but also little if any additional space is required in contrast were a typical separate universal joint attachment used. Hence the wrench can be advantageously employed in confined places where space otherwise prevents use of a separate universal joint.

BRIEF DESCRIPTION OF THE DRAWINGS

FIG. 1 is an isometric, overall view of a plier type of ratchet wrench with which the present invention can be used.

FIG. 2 is a sectional view taken along the line 2—2 of FIG. 1, a socket being shown in phantom in position on the drive shaft.

FIG. 3 is similar to FIG. 2 but shows the drive shaft "flexed" relative to the wrench and the socket in turn "flexed" relaive to the drive shaft.

FIG. 4 is an isometric view of the "hour-glass" shaped drive shaft itself.

DETAILED DESCRIPTION OF THE PREFERRED EMBODIMENT

As noted, the invention is shown applied to a plier type ratchet wrench such as that described in the foregoing patent. That wrench comprises a body 10, one end of which forms a fixed handle 11 while the remainder consists of a pair of spaced plates 12 and 13, forming opposite faces of the wrench, between whose roots is journaled at 14 a movable handle 15. The latter operates a thrust rod 16 which engages and drives a ratchet wheel 17 having opposite bosses 18 by which it is journaled in and between the plates 12 and 13 at their outer ends. The thrust rod 16 cooperates with a pawl 19 journaled at 20 between the plates 12 and 13. Axially through the ratchet wheel 17 is broached a square drive shaft aperture 21 having side walls 21*a* in which is disposed a socket drive shaft generally designated at 22.

The drive shaft 22 is also square in cross-section and is axially slidable in the aperture 21 so that one or the other of its ends projects beyond one or the other of the plates 12 or 13 to receive a typical socket 23 thereon, one end of the latter also having a square drive aperture 24 with side walls 24*a*. The side walls of the drive shaft, however, as mentioned, are of a generally "hour-glass" shape such that the convex extents thereof form a pair of drive portions 25 having a common junction 26 therebetween at the mid-point of the drive shaft 22. In practice, however, each side wall of each drive portion 25, instead of being curved, comprises a pair of flat faces or walls 27*a* and 27*b* which adjoin each other at a transverse apex 28, whence the cross-sectional areas of the drive shaft 22 at the junction 26 and at its outer ends is less than that at its apices 28. One side of the drive shaft 22 is provided with a centrally located, shallow channel 29, closed at its ends. The latter channel receives the inner end of a roll pin 30 radially through the ratchet wheel 17 in order to retain the drive shaft 22 within the ratchet drive aperture 21 and yet allow it to be slid therein so that one or the other of the drive portions 25 projects beyond the plate 12 or 13. A pair of spring loaded ball detents 31 are provided at the two apices 28 on one side of the drive shaft 22 in order to yieldably retain one of the drive portions 25 in the ratchet drive aperture 21 and the other in the socket drive aperture 24.

Accordingly, the generally convex shape of the two drive portions 25 allows the axis of the drive shaft 22 and the axes of the two drive apertures 21 and 24 of the ratchet wheel 17 and socket 23 to be all aligned as shown by the line A—A in FIG. 2 representing the axis of the drive aperture 21. At the same time, each of the drive portions 25 can swivel relative to the two drive apertures 21 and 24. Hence, the axis B of the drive shaft 22 can swivel about an included acute angle M relative to the axis A of the ratchet drive aperture 21 while simultaneously the axis C of the socket drive aperture 24 can also swivel about an included acute angle N relative to the axis B of the drive shaft 22, all as shown in FIG. 3. Hence, the angle through which the socket 23 can swivel is M plus N, rather than just M as in the prior art. A significant amount of additional "universal joint" action is thus available without the need of a separate or additional universal joint attachment between the drive shaft and the socket, all of which is accomplished at relatively little cost and compexity.

The invention, of course, could be applied to the other type of ratchet wrench in which the drive shaft is not slidable relative to the ratchet in order to reverse the direction of ratchet action, but in which that reversal is achieved by other means. In such a case, the swivelling end of the drive shaft which is therefore permanently anchored within the ratchet could be of a size or shape other than that of the end which receives the socket. Hence, though the present invention has been shown and described in terms of a particular embodiment, being the best mode known of carrying out the invention, it is not limited to that embodiment alone. Instead the following claims are to be read as encompassing all adaptations and modifications of the invention falling within its scope and spirit.

I claim:

1. In a ratchet wrench including a ratchet member and a socket drive member mounted for rotation about a common axis relative to the remainder of the wrench, the ratchet member having a drive aperture therein about said axis, the drive member and ratchet member drive aperture having corresponding side walls disposed about said axis, the drive member having a pair of axially spaced drive portions each of which includes portions of the drive member side walls between two axially spaced locations therealong, one of the drive portions being disposed in the ratchet member drive aperture with its side walls in opposed relation to the ratchet member drive aperture side walls for driving rotation of the drive member about said axis by the ratchet member, the other of the drive portions projecting beyond one face of the wrench to removably slidably receive thereon the drive aperture of a socket for driving rotation of the socket by the drive member, and means retaining the drive member in the drive member aperture, the improvement wherein the drive member can swivel relative to the ratchet member and a socket disposed on the projecting drive portion as aforesaid can simultaneously swivel relative to the drive member, said improvement comprising the side walls of each drive portion each having a generally convex configuration such that the cross-sectional areas of each drive portion at said locations therealong are less than cross-sectional areas of the drive portion between said locations.

2. The wrench of claim 1 wherein the drive member is slidable in the ratchet member drive aperture between selective positions in which one or the other of the ratchet portions is disposed in the ratchet member drive aperture as aforesaid while one or the other of the drive portions projects beyond one or the other of a pair of opposite faces of the wrench in order to receive a socket thereon as aforesaid.

3. The wrench of claim 2 wherein the opposite axial ends of the drive member comprise one of said locations along each of the drive portions, the other of said locations along each of the drive portions constituting a common juncture of the drive portions disposed between said axial ends.

4. The wrench of claim 3 wherein each side wall of each drive portion comprises a pair of generally planar walls adjoining each other to form an apex disposed between said common juncture and the respective one of said axial ends of the drive member.

5. The wrench of claim 4 including detent means disposed at one of said apices of each of the drive portions and respectively resiliently engagable with the ratchet member and socket drive apertures.

* * * * *